US011965251B2

(12) United States Patent
Wang et al.

(10) Patent No.: US 11,965,251 B2
(45) Date of Patent: Apr. 23, 2024

(54) ONE-STEP METHODS FOR CREATING FLUID-TIGHT, FULLY DENSE COATINGS

(71) Applicants: Daming Wang, Carmel, IN (US); Ardy S Kleyman, Carmel, IN (US); Kasey D Hughes, Crawfordsville, IN (US)

(72) Inventors: Daming Wang, Carmel, IN (US); Ardy S Kleyman, Carmel, IN (US); Kasey D Hughes, Crawfordsville, IN (US)

(73) Assignee: Praxair S.T. Technology, Inc., North Haven, CT (US)

( * ) Notice: Subject to any disclaimer, the term of this patent is extended or adjusted under 35 U.S.C. 154(b) by 0 days.

(21) Appl. No.: 16/531,533

(22) Filed: Aug. 5, 2019

(65) Prior Publication Data

US 2020/0048753 A1 Feb. 13, 2020

Related U.S. Application Data

(60) Provisional application No. 62/717,355, filed on Aug. 10, 2018.

(51) Int. Cl.
*C23C 4/129* (2016.01)
*C23C 4/10* (2016.01)

(52) U.S. Cl.
CPC ..... *C23C 4/129* (2016.01); *C23C 4/10* (2013.01)

(58) Field of Classification Search
CPC ..... C23C 4/129; C23C 4/10; B05B 7/205
USPC ..... 427/446–456
See application file for complete search history.

(56) References Cited

U.S. PATENT DOCUMENTS

| | | | | |
|---|---|---|---|---|
| 6,416,877 | B1 * | 7/2002 | Perrin | C23C 4/00 148/531 |
| 2004/0031776 | A1 * | 2/2004 | Gevelber | C23C 4/134 219/121.36 |
| 2010/0151124 | A1 * | 6/2010 | Xue | B05B 7/1486 427/185 |
| 2010/0183842 | A1 * | 7/2010 | Kawakita | B05B 7/205 428/141 |

(Continued)

FOREIGN PATENT DOCUMENTS

| | | | |
|---|---|---|---|
| JP | 2005068457 | A | 3/2005 |
| JP | 2012112012 | A | 6/2012 |
| WO | 2010/109223 | A1 | 9/2010 |

OTHER PUBLICATIONS

T.C. Hanson et al.; Particle Temperature and Velocity Effects on the Porosity and Oxidation of an HVOF Corrosion-Control Coating; Journal of Thermal Spray Technology; JTTEE5 12:403-415; ASM International; vol. 12(3), Sep. 2003; pp. 403-415.

(Continued)

*Primary Examiner* — Dah-Wei D. Yuan
*Assistant Examiner* — Nga Leung V Law

(57) ABSTRACT

A fluid tight, fully-densified, coating is prepared by a High Velocity Oxygen Fuel ("HVOF") process that dilutes oxygen with an inert gas. The inert gas is pre-mixed with oxygen prior to the oxygen entering a combustion chamber. The resultant flame temperature is lowered a controlled amount to eliminate, minimize or reduce oxidation of power feedstock that is injected into the thermal spray torch. The ability to reduce the flame temperature allows a relatively smaller particle feedstock to be deposited without significant oxidation. The dilution process creates an as-deposited fully-dense, fluid tight coating.

15 Claims, 6 Drawing Sheets

(56) References Cited

U.S. PATENT DOCUMENTS

| | | | | |
|---|---|---|---|---|
| 2012/0261603 | A1 | 10/2012 | Kahn et al. | |
| 2013/0126773 | A1* | 5/2013 | Ajdelsztajn | F16K 3/30<br>251/368 |
| 2016/0348971 | A1* | 12/2016 | Kurisu | C21D 9/56 |

OTHER PUBLICATIONS

Daryl E. Crawmer, Thermal Spray Processes, Handbook of Thermal Spray Technology, 2005, pp. 54-57.

Zha Bai-Lin, et al., Influence of HVO-AF Parameters and Particle Size on Elastic Modulus of WC-12Co Coatings, Journal of Materials Engineering, Apr. 2015, pp. 92-97, vol. 43, No. 4.

* cited by examiner

ONE-STEP METHODS FOR CREATING FLUID-TIGHT, FULLY DENSE COATINGS

RELATED APPLICATIONS

The present application claims the benefit of priority to U.S. Application Ser. No. 62/717,355, filed Aug. 10, 2018, which is hereby incorporated by reference in its entirety for all purposes.

FIELD OF THE INVENTION

The present invention generally relates to one-step high velocity oxygen fuel ("HVOF") methods for creating fluid-tight, fully dense coatings for a variety of applications. Particularly, the HVOF method involves a controlled dilution of oxygen with an inert gas to reduce the flame temperature, thereby enabling use of relatively small particle sized powder feedstock to create the fluid-tight, fully dense coatings without the use of a sealant.

BACKGROUND OF THE INVENTION

Wear and corrosion is a problem for substrate surfaces (e.g., metallic substrate surfaces formed from nickel, cobalt, iron and copper alloys) that are exposed to harsh corrosion conditions which can degrade their structural integrity. For instance, aviation seal components, and valves utilized in oil and gas applications typically encounter high contact pressure and high temperature conditions throughout their service life. Corrosion of these surfaces exacerbates wear and frictional problems. Consequently, these components must exhibit resistance to corrosion and must be impermeable to gases and liquids.

Thermal spray coatings such as WCCrCo are routinely utilized for wear and corrosion protection. To achieve near full density, a second coating step is required such as coating impregnation with a polymeric sealer. While the wear resistant coatings with the polymeric sealer have proven successful at lower operating pressure regimes of 15,000 psi or less, and temperatures of 350 F. or less, they are typically inadequate as the oil supply and pump lines approach higher pressures and temperatures. Under higher temperatures, the coatings can potentially exhibit gas leakage through the coating itself due to thermal degradation of the polymeric sealer. Failure to utilize a coating having adequate fluid impermeability, can cause leakage of fluid through the coating and eventually through the valve and seals.

Another two-step process for creating a fully dense coating involves a deposition of self-fluxing alloy or a blend of WC based material with a self-fluxing alloy by a combustion thermal spray followed by the flame fusing or fusing in oven at temperatures above 1800° F. Besides employing the time consuming and costly fusing process, the major shortcomings of spray fuse coatings are potential risks of distortion of coated parts and coating cracking when such coatings are not compatible with the substrate material.

In view of the drawbacks of conventional coatings, there is an unmet need for an improved coating process for creating fluid-tight, fully dense coatings.

SUMMARY OF THE INVENTION

The invention may include any of the following aspects in various combinations and may also include any other aspect of the present invention described below in the written description.

Other aspects, features and embodiments of the disclosure will be more fully apparent from the ensuing description and appended claims.

In a first aspect, a one-step method for creating a thin, fluid-tight, as-deposited coating without sealing the as-deposited coating, comprising: providing a substrate; providing a powder feedstock having a particle size ranging from 1 to 15 microns; providing a thermal spray torch, said thermal spray torch comprising a combustion chamber with a comprising a nozzle downstream of the combustion chamber; introducing a fuel into the combustion chamber; pre-mixing oxygen gas with an inert gas to produce diluted oxygen gas, wherein the pre-mixing occurs prior to the oxygen gas entering the combustion chamber, and wherein a flow ratio of the inert gas to the oxygen gas ranges from 8:92 to 50:50; introducing the diluted oxygen gas into the combustion chamber; combusting the fuel with the diluted oxygen gas to generate a flame; introducing the powder feedstock into the nozzle; contacting the powder feedstock with the flame to produce substantially molten and semi-molten droplets; and directing the substantially molten and semi-molten droplets to the substrate.

In a second aspect, a one-step method for creating a thin, fluid-tight, as-deposited coating without sealing the as-deposited coating, comprising: providing a substrate; providing a powder feedstock having a particle size ranging from 1 to 15 microns; providing a thermal spray torch, said thermal spray torch comprising a combustion chamber and said torch further comprising a nozzle downstream of the combustion chamber enclosed therein; introducing a fuel into the combustion chamber; pre-mixing oxygen gas with an inert gas to produce diluted oxygen gas; directing the diluted oxygen gas into the combustion chamber; combusting the fuel with the diluted oxygen gas to generate a flame within the combustion chamber; controlling a flame temperature in the combustion chamber; introducing the powder feedstock into the nozzle; heating the powder feedstock to produce substantially molten or semi-molten droplets with reduced oxidation in comparison to conventional high velocity oxygen fuel processes using the powder feedstock with the particle size ranging from 1 to 15 microns.

In a third aspect, a thin, fluid-tight, as-deposited, one-step thermal spray coating without sealer created by an oxygen dilution High Velocity Oxygen Fuel ("HVOF") process, said coating derived from a tungsten carbide-based powder composition with a particle size ranging from 1-15 microns and a coating thickness no greater than 100 microns, wherein the fluid-tightness is characterized by an absence of visually detectable fluid leakage at pressures of 10,000 psi or greater, and a fully dense structure as defined by an absence of interconnected pores.

BRIEF DESCRIPTION OF THE DRAWINGS

The objectives and advantages of the invention will be better understood from the following detailed description of the preferred embodiments thereof in connection with the accompanying figures wherein like numbers denote same features throughout and wherein.

DETAILED DESCRIPTION OF THE INVENTION

The disclosure is set out herein in various embodiments, and with reference to various features and aspects of the invention. The disclosure contemplates such features, aspects and embodiments in various permutations and combinations, as being within the scope of the disclosure. The disclosure may therefore be specified as comprising, consisting or consisting essentially of, any of such combinations and permutations of these specific features, aspects and embodiments, or a selected one or ones thereof.

As will be described, the present invention offers a novel one-step method for creating a fluid-tight, fully dense coating without the use of a sealer or fusing step.

Unless indicated otherwise, all compositions herein are in weight percent, and are intended to include unavoidable trace contaminants.

The term "fluid" as used herein and throughout the specification is intended to refer to a liquid, slurry, gas or vapor, or any combination thereof.

As used herein, and throughout, the term "fully dense" is characterized by exhibiting fluid tightness whereby no discernable fluid leakage is detected upon high pressure leak testing, and no substrate corrosion is observed.

Figure 4:
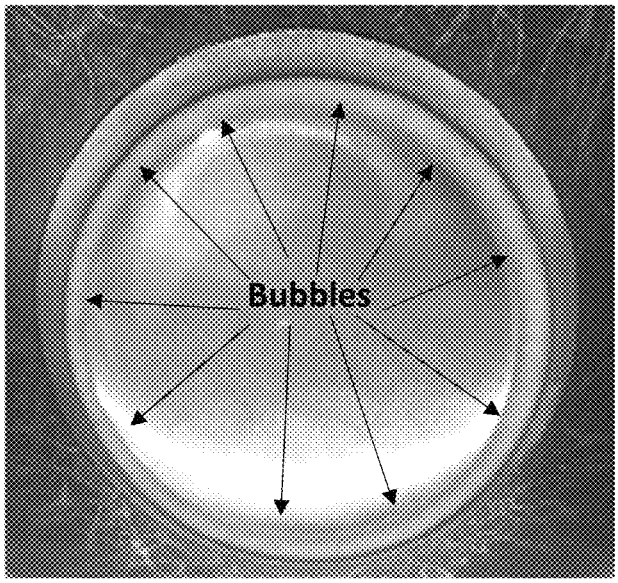
FIG. 4 shows results of a high pressure leak test for a tungsten carbide-based thermal spray coating created by conventional HVOF, as described in Comparative Example 1.
Figure 5:
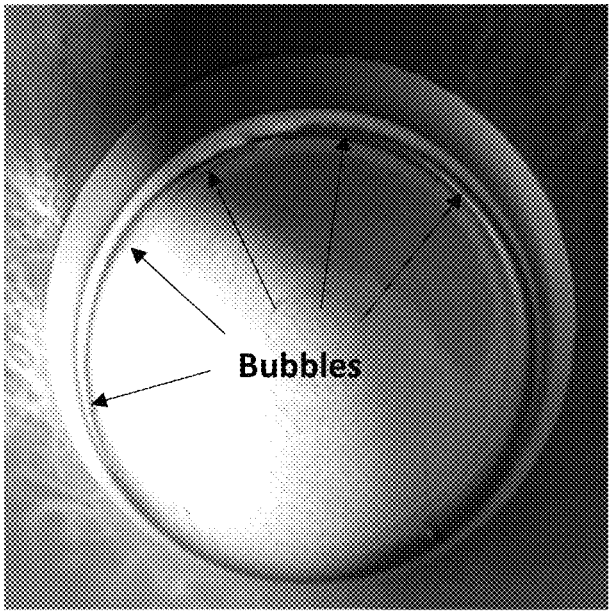
FIG. 5 shows results of a high pressure leak test for a tungsten carbide-based thermal spray coating using a powder size of 1-15 microns without oxygen dilution, as described in Comparative Example 2.
Figure 6:
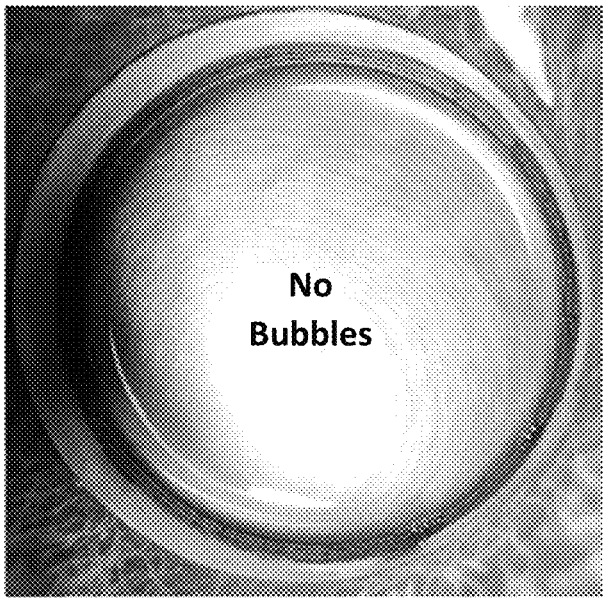
FIG. 6 shows results of a high pressure leak test for a tungsten carbide-based thermal spray coating created by the present invention, as described in Example 1.

The term "high pressure leak testing" refers to the leak testing carried out in the Working Examples and which is shown in FIGS. 4, 5, and 6.

"One-step" as used herein and throughout means as-deposited.

"Flow ratio" as used herein and throughout means a ratio of flow rate of inert gas to oxygen gas.

The terms "conventional HVOF" and "standard HVOF" are used interchangeably and are intended to mean a high velocity oxygen fuel process without oxygen dilution and without a relatively fine particle size of 1-15 microns.

The terms "fine particle size" and "relatively fine particle size" are used interchangeably and are intended to mean a particle size of 1-15 microns.

Figure 1:
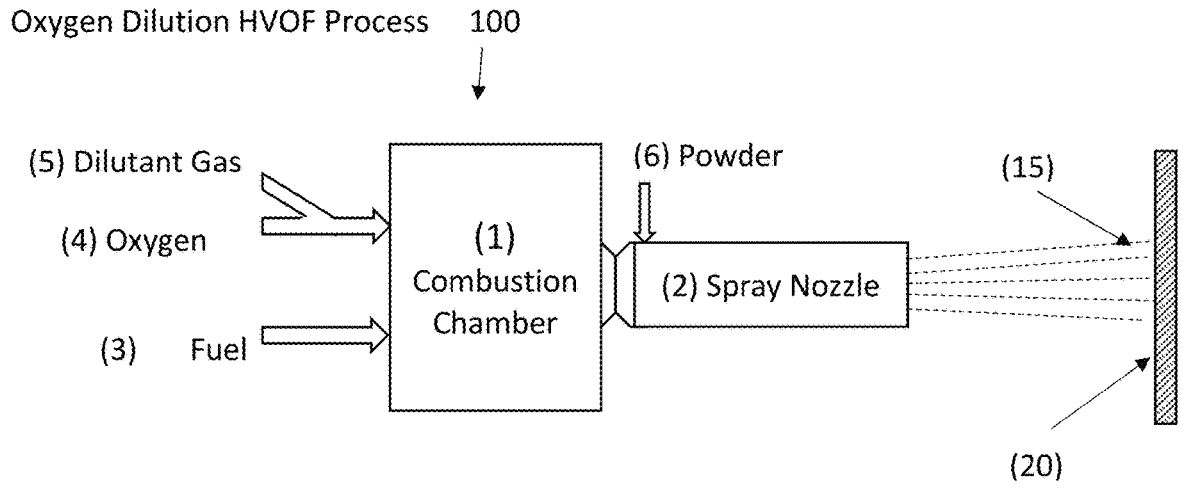
FIG. 1 shows a process schematic that is representative of the present invention, in accordance with the principles of the present invention.

FIG. 1 shows a process schematic that is representative of one aspect of the present invention, referred to as an oxygen dilution HVOF process 100. A powder feedstock 6 is introduced into a spray nozzle 2 of a thermal spray torch. The powder feedstock 6 has a particle size ranging from about 1 to 15 microns. The powder feedstock 6 can be any suitable chemical composition of a thermal spray powder. In a preferred embodiment, the powder feedstock 6 is a tungsten carbide-based material. The tungsten carbide-based material can have a formulation of 86% WC-10% Co-4% Cr. Other compositions can also be used, such as, by way of example and not intending to be limiting, 88% WC-12% Co; 83% WC-17% Co; 90% WC-10% Ni; and chromium carbide based powder feedstocks. The powder feedstock 6 is radially injected into the spray nozzle 2, which is located downstream of a combustion chamber 1. A suitable carrier gas such as nitrogen or argon may be used to convey the powder feedstock 6 into the spray nozzle 2. The carrier gas may have a flow rate of 20 to 50 scfh, but is generally no greater than 35 scfh. Higher carrier gas flow rates can cause the powder feedstock 6 to prematurely erode the spray nozzle 2, thereby resulting in a shorter operational life of the spray nozzle 2. Alternatively, or in addition thereto, excessive carrier gas flow rates can adversely affect coating properties. The exact amount of powder feedstock 6 to be introduced into the spray nozzle 2 is dependent upon several factors, including but not limited to, a ratio of flow of oxygen 4 to flow of fuel 3; total flow of the oxygen 4 and fuel 3; and powder chemistry.

Figure 2:
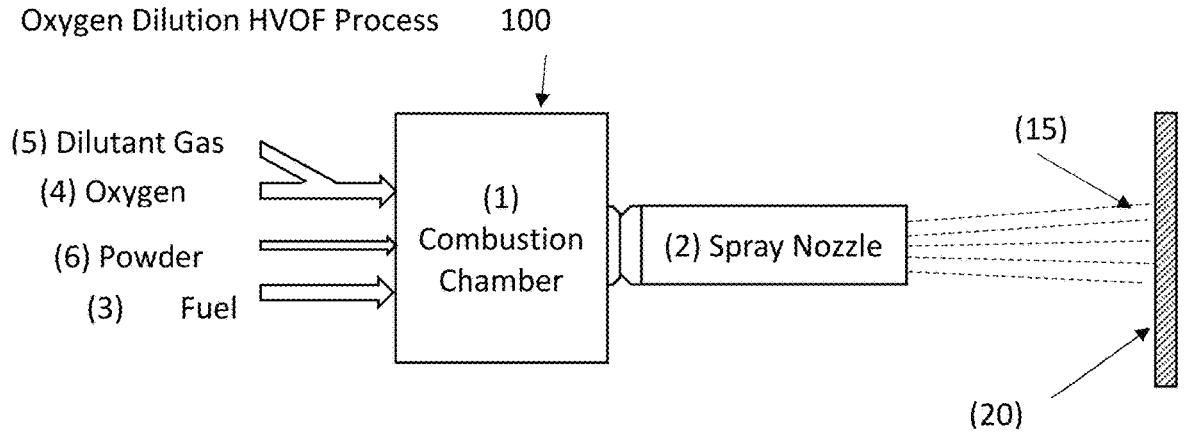
FIG. 2 shows an alternative process schematic of the present invention, in accordance with the principles of the present invention.

Still referring to FIG. 1, oxygen gas 4 is pre-mixed with an inert gas 5 before the oxygen gas 4 contacts the fuel 3 in the combustion chamber 1. The inert gas 5 is nitrogen, as shown in FIG. 1 and FIG. 2. The inventors have discovered that a controlled addition of nitrogen gas 5 to pre-mix with oxygen gas 4 prior to combustion of the fuel 3 can advantageously lower the flame temperature in comparison to a flame temperature generated with a standard HVOF process, such that oxidation of the relatively fine powder particles is reduced, eliminated or minimized. "Flame temperature" as used herein and throughout is intended to refer to the temperature of the various by-products produced from the combustion of fuel 3 with oxygen gas 4 that is pre-mixed with or without an inert gas 5; and "flame" as used herein and throughout is intended to refer to the various by-products produced from the combustion of fuel 3 with oxygen gas 4 that is pre-mixed with or without an inert gas 5.

Fuel 3 is introduced into the inlet of the combustion chamber 1. Any suitable fuel 3 can be used, including a hydrocarbon based fuel, such as kerosene. Alternatively, the fuel 3 can be hydrogen. The oxygen gas 4 is preferably introduced at a flow rate that is sufficient to combust substantially all of the fuel 3. Specifically, the oxygen is preferably introduced in an amount based on the stoichiometric ratio of fuel 3 to oxygen 4. Optimization of the HVOF dilution process 100 can occur when the flow ratio of nitrogen gas 5 to oxygen 4 is maintained at or above a lower limit and at or below an upper limit. In this manner, the reduction in flame temperature as a result of the pre-mixing eliminates, minimizes or reduces the amount of oxidation that the relatively fine powder feedstock 6 undergoes, thereby allowing the relatively fine particle size of about 1-15 microns to be utilized. The relatively fine particle size preferably has a median particle size ranging from about 6-10 microns. In another embodiment, the powder feedstock 6 can have a particle size ranging from 4-12 microns. The ability for the present invention to control flame temperature and utilize such a relatively fine particle size allows a fully-dense, fluid tight coating to be created.

The flow ratio of nitrogen gas 5 to oxygen gas 4 is maintained at or above a lower limit of 8:92 but no greater than an upper limit of 50:50. The inventors have observed that if the flow ratio of nitrogen gas 5 to oxygen gas 4 falls below the lower limit ratio of 8:92, the benefits of the nitrogen dilution are not achieved. In particular, sufficient cooling of the flame does not occur and the powder feedstock 6 will have a tendency to undergo appreciable oxidization from the higher flame temperature, which imparts a significant amount of heat to the relatively fine powder particles. In comparison to conventional HVOF processes which utilize larger particle sizes, the relatively fine particles of powder feedstock 6 used in process 100 have a high ratio of surface area per unit volume that can cause the powder feedstock 6 to deteriorate as a result of undergoing severe oxidization and decarburization before the powder feedstock 6 particles impinge onto the substrate 10 surface to form the coating. A resultant coating with severe oxidation will not have the fluid tightness and a fully dense structure of a coating prepared by the present invention. Instead, the resultant coating with the severe oxidation has oxide inclusions which essentially act as undesirable flow passages for gas leakage to occur. Gas leakage through the coating potentially leads to impairment of the coating.

On the other hand, introducing nitrogen gas 5 in an amount above an upper limit of a flow ratio of 50:50 of the nitrogen gas 5 to oxygen gas 4 has a tendency to cause the flame to extinguish as the combustion reaction is not sustainable. The flame temperature becomes too low to treat the powder particles as a result of the oxygen gas 4 becoming excessively diluted above the flow ratio of 50:50.

In another aspect of the invention, in addition to maintaining the flow ratio at or above the lower limit and at or below an upper limit, the total flow rate of nitrogen gas 5 and oxygen gas 4 that is introduced into the combustion chamber 1 is maintained within a range of 500 scfh to 3000 scfh to ensure optimal conditions are created and maintained for combustion of the diluted oxygen with the fuel 3.

In another embodiment, the flow ratio of nitrogen gas 5 to oxygen gas 4 is maintained between 8:92 to 50:50, preferably between 10:90 to 30:70 and more preferably between 12:88 to 18:82.

Illustrative parameters for carrying out the HVOF oxygen dilution process of FIG. 1 include feeding oxygen gas 4 at a flow rate of 400-2500 standard cubic feet per hour (scfh) with the nitrogen gas 5 pre-mixed with the oxygen gas 4 at a flow rate of 50-600 scfh such that the weight ratio of nitrogen gas 5 to oxygen gas 4 is maintained between 8:92 to 50:50, and the total flow of oxygen gas 4 and nitrogen gas 5 is maintained at about 500-3000 scfh. Kerosene can be used as the fuel 3 and is generally introduced into the combustion chamber 1 at a flow rate of 2.5-6.5 gallons per hour (gph).

Alternatively, in another aspect of the present invention, the process 100 can be carried out with hydrogen as the fuel 3. Hydrogen can be injected at a flow rate of 1000-1800 scfh into the combustion chamber 1 of the torch. A tungsten carbide-based powder feedstock 6 having a size ranging from about 1 to 15 microns is fed axially into the spray nozzle 2 at a feed rate of 20-100 gram per minute. The oxygen 4 pre-mixes with nitrogen 5 to produce an oxygen diluted gas remain as previously described. The weight ratio of nitrogen gas 5 to oxygen gas 4 is maintained at or above a lower limit of 8:92 but no greater than an upper limit of 50:50; and the total flow rate of oxygen 4 and nitrogen 5 is maintained within a range of 500 scfh to 3000 scfh.

Still referring to FIG. 1, as the powder feedstock 6 is injected radially into the spray nozzle 2, the powder feedstock 6 contacts the flame and becomes molten or semi-molten. The particles exit the spray nozzle as effluent 15 and are directed against a substrate surface 20 where they solidify upon impact to create a coating. The actual spraying with the HVOF process 100 of FIG. 1 can occur by a stationary or moving HVOF torch. In the case of the substrate surface 20 remaining stationary, the HVOF torch device is traversing at a speed of 600-3200 inches per minute and a 0.2 index across the surface of the substrate 20. The HVOF torch is maintained at a certain standoff distance (e.g., 2-10 inches) away from the surface of the substrate 20.

Pre-mixing of the oxygen gas 4 with the nitrogen gas 5 is critical to the present invention, and must occur prior to the oxygen gas 4 enters the combustion chamber 1 as shown in FIGS. 1 and 2. If the oxygen gas 4 and the nitrogen gas 5 are not premixed, but, instead, separately introduced into the combustion chamber 1, a non-uniform mixture is typically created and has a tendency to create turbulent flow regimes within the combustion chamber 1, which results in a non-uniform flame temperature. The non-uniform flame temperature consists of hot and cold spots within the chamber 1. Ultimately, there is not uniform velocity distribution throughout the effluent 15 that exits the spray nozzle 2. As a result, some fine powder particles of the effluent 15 can be over treated or under treated which may result in excessive oxidation, decarburization, higher porosity and unmelted particles in the resultant coating that is deposited onto the substrate 20.

The ability for the present invention by virtue of diluting the oxygen gas to utilize relatively fine particles to create a fully dense, fluid-tight resultant coating eliminates the need to impregnate the coating with a sealer. Therefore, the so-called "one-step" process 100 does not require a subsequent step of applying a sealer. In contrast, conventional HVOF as-sprayed coating processes inherently exhibit interconnected porosity that creates a flow path for gas to travel therealong, thereby necessitating a subsequent sealer to be applied.

The use of small particle sizes has been challenging until the emergence of the present invention. In particular, the use of small particles has not been considered a viable process implementation for conventional HVOF processes as a result of (i) a shortened life expectancy of the spray nozzle 2 due to the tendency of the relatively fine particles to clog the spray nozzle 2; and (ii) the observation that the oxidation and decarburization of such small particle sizes from the flame of a conventional HVOF process is excessive and can impair the resultant coating.

Only the present invention offers an oxygen diluted HVOF thermal spray process 100 for creating a fluid-tight, fully dense coating as-deposited without sealer. The process 100 is designed for reducing or eliminating oxide inclusions by reducing the flame temperature. The fluid tightness of the present invention can withstand relatively high pressure conditions as will be shown in Example 1. Accordingly, the present invention offers not only acceptable fluid tightness, but surprisingly does so in the absence of post coating treatments, such as applying a sealer or fusing the coating. The fluid tightness is exhibited at pressures of at least 10000 psi, which can be encountered by components (e.g., gate and seat components and ball valves as utilized in oil and gas applications).

Figure 7:
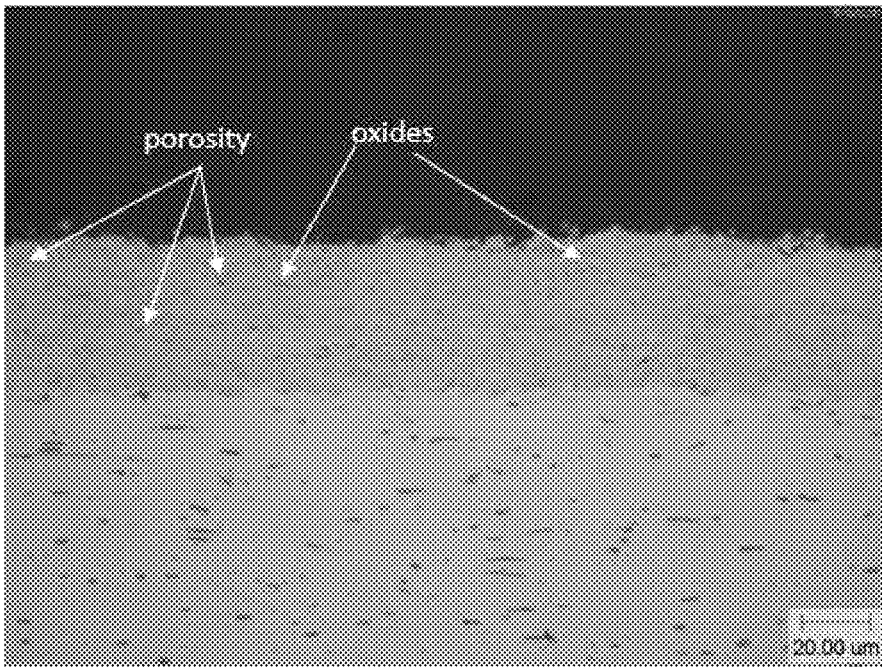
FIG. 7 shows a microstructure of a coating created by the present invention under an optical microscope at 500× magnification.
Figure 8:
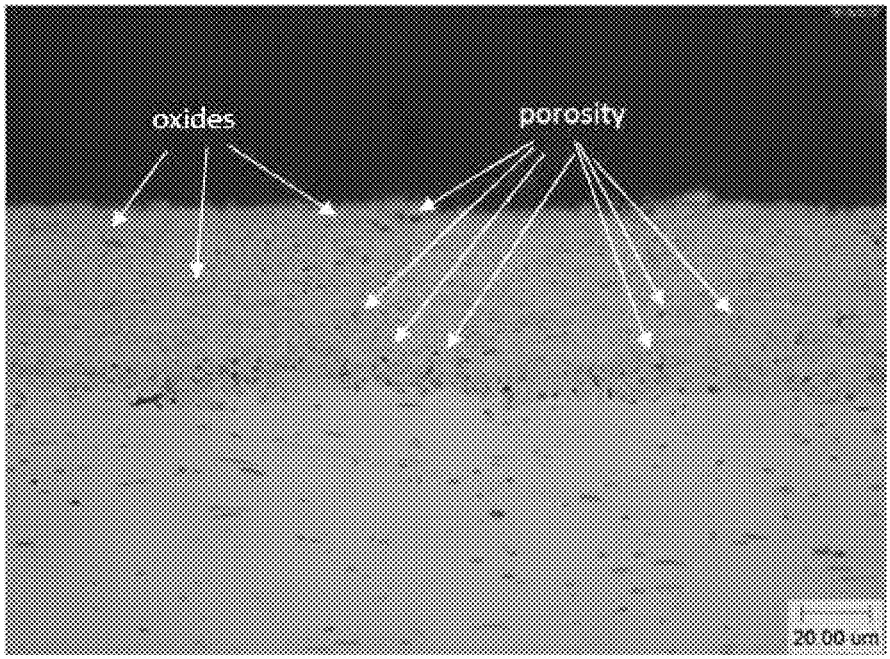
FIG. 8 shows a microstructure of a coating created by HVOF without oxygen dilution using a powder size of 1-15 microns, under an optical microscope at 500× magnification.

FIG. 7 shows a micrograph of a coating created by the process 100 under an optical microscope at 500× magnification. In comparison to FIG. 8, which represents a coating created with a powder having a particle size of 1-15 microns using a conventional HVOF process without pre-mixing of oxygen with an inert gas, FIG. 7 shows that the HVOF coating created by the present invention has lower porosity (where porosity is indicated by voids) and lower oxide level (where oxide level is indicated by gray stringers).

Other process variations are contemplated by the present invention. For example, FIG. 2 shows an alternative embodiment of the process 100, in which the powder feedstock 6 is axially injected into the combustion chamber 1. Additionally, other suitable inert gases may be used besides nitrogen to dilute the oxygen to adequate levels. For example, and not intending to be limiting, argon may be used as an inert gas to pre-mix with oxygen to produce a diluted oxygen gas, wherein the pre-mixing occurs prior to the oxygen gas entering the combustion chamber.

In addition to the advantages described, the present invention overcomes many of drawbacks of a high velocity air fuel process (HVAF) which utilizes mixtures of air and fuel. Specifically, in order to maintain combustion with HVAF, a significantly higher amount of air must be introduced into the combustion chamber of the thermal spray torch in comparison to the present invention to maintain combustion of the fuel, as oxygen content in air is relatively low. By way of example, in certain instances, the flow rate of air in the HVAF process can be up to 10 times that of the total flow of oxygen and nitrogen gas that is required in the present invention. The higher flow rate of air for HVAF requires a higher volume of compressed air, thereby increasing the cost to perform an HVAF process. On the contrary, the present invention is a much lower cost alternative to HVAF because a lower flow rate of oxygen and inert gas can be utilized in the present invention to achieve sufficient combustion. The addition of the nitrogen gas 5 is preferably less than 20 vol % of the total oxygen and nitrogen flow, which is drastically different in comparison to HVAF processes, with air consisting of 78 vol % of nitrogen.

Additionally, and in another aspect, the present invention is capable of producing a fluid-tight, fully dense coating with the required properties at a thickness substantially less than conventional HVOF coatings. For example, in one embodiment of the present invention, the coating thickness is no greater than 100 microns, more preferably no greater than 50 microns, and most preferably no greater than 25 microns, while still exhibiting the same properties of a sealed conventional HVOF coating that is 100 microns thick or more. The fluid-tightness of the HVOF coating produced by the present invention is characterized by an absence of a visually detectable fluid leakage at pressures of 10,0000 psi or greater. The fully dense structure is defined by an absence of interconnected pores, whereby the absence of interconnected pores is sufficient to prevent fluid leakage through the coating at the same or even a fraction of the thickness of conventional sealed HVOF coatings Coatings prepared by the present invention can tolerate higher temperatures than previously possible with conventional coatings that incorporated a sealer, which tend to degrade at high temperatures (e.g., 350 deg F. or higher). In this regard, the fully-dense fluid tight coating prepared by the present invention is not formulated with a specific type of polymeric sealer as no impregnation is required. The working examples that will be discussed below quantify the improved performance of the fully-dense coating system made by the present invention in comparison to coatings made by conventional HVOF.

The fluid tight, fully-dense coatings prepared by the present invention are suitable for any substrate surface having one or more sealing surfaces. By way of example, and not intending to be limiting, the oxygen dilution HVOF process can be used to create coatings onto aviation and industrial hydraulic components in which the cylinders or their mating surfaces (bushings or bearings) are at least partially coated. Additionally, the coatings prepared by the present invention are particularly suitable for metallic load bearing surfaces, including, but not limited to, gate valve and ball valve components in fluid flow control systems.

As will be shown and discussed below in the Working Examples, several experiments were performed to compare the fully-dense coatings prepared by the present invention with other HVOF coatings prepared by conventional processes. The criteria for a successful test was dependent upon the coating's ability to achieve and create a fluid impermeable seal.

Figure 3:
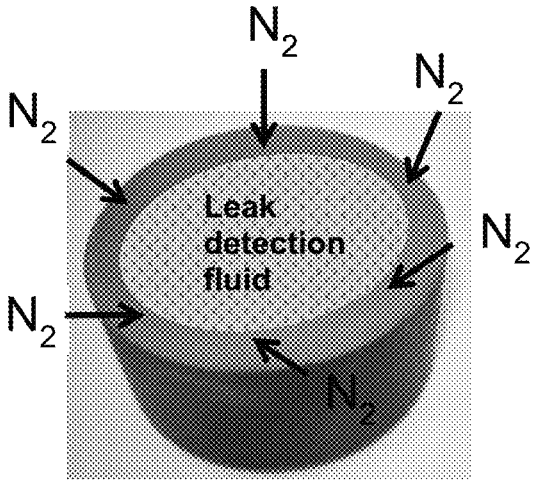
FIG. 3 shows a test set-up employed to replicate high pressure leakage.

The experiments simulated high pressure conditions typically encountered by gate valves utilized in oil and gas applications. The test sample as shown in FIG. 3 was used to replicate high pressure leakage. High pressure leak testing was used to investigate the gas leakage through the coating. The test consisted of subjecting a portion of a coated sample to nitrogen at a pressure of 10,000 psi for a minimum of 10 min as shown by the arrows in FIG. 3, while another portion of the coated sample was submitted to atmospheric pressure and covered with a thin layer of leak detection fluid. If the coating was permeable to the nitrogen gas, bubbles were observed on the coating surface during the test.

Comparative Example 1

A tungsten carbide based powder having the formulation 86% WC-10% Co-4% Cr powder was employed to produce a coating using a conventional High Velocity Oxygen Fuel ("HVOF") coating process. Oxygen and kerosene fuel were axially introduced separately into the inlet of the combustion chamber of a commercially available thermal spray torch (JP-5000 made by Praxair TAFA) and the tungsten carbide based powder was radially injected into the spray nozzle. The tungsten carbide powder had a particle size ranging from 15-45 microns, with a median particle size of 30 microns. Oxygen gas was introduced at 2000 scfh. The oxygen gas was not diluted. Kerosene was introduced at a flow rate of 6.5 gallon per hour. The tungsten carbide based powder was injected radially into the spray nozzle at a feed rate of 80 grams per min. Nitrogen carrier gas at a flow rate of 22 scfh was used to convey the tungsten carbide based powder into the spray nozzle.

The substrate to be coated remained stationary while the torch was traversed and indexed across the part. The standoff distance between the torch and part was 15 inches and the surface speed (i.e., torch speed) was advanced along the flat surface of the part at 1800 inches per min.

The finished coating (200 micron) was applied and tested on the sample having a diameter of approximately 2.8 inches and a thickness of approximately 1.5 inches.

A high pressure leak test to the coated substrate was conducted. A significant amount of bubbles was observed along the periphery of the test sample as shown in FIG. 4 at an applied pressure of 10,000 psi. The large amount of bubbles was an indication of the inability of the coating to prevent leakage.

Comparative Example 2

A tungsten carbide based powder having the formulation 86% WC-10% Co-4% Cr powder with particle size ranging from 1 to 15 micron was employed to produce a coating using a conventional HVOF coating process. The median particle size was 8 microns. Oxygen and kerosene fuel were axially introduced separately into the inlet of the combustion chamber of a commercially available thermal spray torch (JP-5000 made by Praxair TAFA) and the tungsten carbide based powder was radially injected into the spray nozzle. The oxygen gas was introduced at 1200 scfh. The oxygen gas was not diluted. Kerosene was introduced at a flow rate of 4 gallons per hour. The tungsten carbide based powder was injected radially into the spray nozzle of the torch at a feed rate of 30 grams per min. Nitrogen carrier gas at a flow rate of 35 scfh was used to feed the tungsten carbide based powder into the spray nozzle.

The substrate to be coated remained stationary while the torch was traversed and indexed across the part. The standoff distance between the torch and part was 8 inches and the surface speed (i.e., torch speed) was advanced along the flat surface of the part at 1800 inches per min.

The thin finished coating (40 micron) was applied and tested on the sample having a diameter of approximately 2.8 inches and a thickness of approximately 1.5 inches.

A high pressure leak test was conducted. A significant amount of bubbles was observed along the periphery of the test sample as shown in FIG. 5 at an applied pressure of 10,000 psi. The large amount of bubbles was an indication of the inability of the coating to prevent leakage.

Comparative Example 3

A tungsten carbide based powder having the formulation 86% WC-10% Co-4% Cr powder was employed to produce a coating using a conventional High Velocity Oxygen Fuel ("HVOF") coating process. Oxygen and kerosene fuel were axially introduced separately into the inlet of the combustion chamber of a commercially available thermal spray torch (JP-5000 made by Praxair TAFA) and the tungsten carbide based powder was radially injected into the spray nozzle. The tungsten carbide powder had a particle size ranging from 10-38 microns. The median particle size was 18 microns. Oxygen gas was introduced at 1925 scfh. The oxygen gas was not diluted. Kerosene was introduced at a flow rate of 6.0 gallon per hour. The tungsten carbide based powder was injected radially into the spray nozzle at a feed rate of 80 grams per min. Nitrogen carrier gas at a flow rate of 32 scfh was used to convey the tungsten carbide based powder into the spray nozzle.

The flat substrate to be coated remained stationary while the torch was traversed and indexed across the part. The standoff distance between the torch and part was 15 inches and the surface speed (i.e., torch speed) was advanced along the flat surface of the part at 1800 inches per min.

The finished unsealed coating (50 micron) was applied and tested on the flat sample having (4 in×3 in×¾ in) dimensions.

Figure 9:
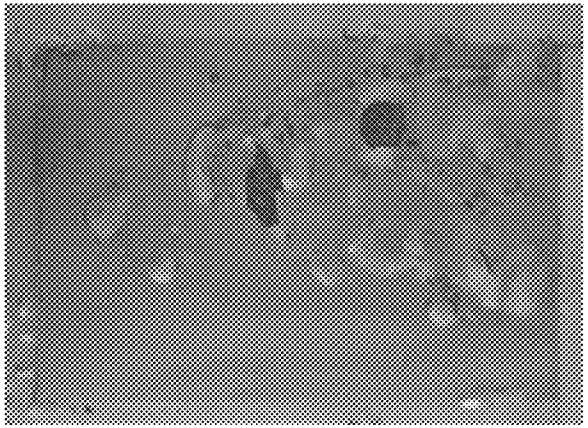
FIG. 9 shows the results of a substrate corrosion test for a tungsten carbide coating created by conventional HVOF.

A salt fog corrosion test was performed per ASTM B117 requirements. Within 72 hours of exposure to a salt fog, signs of corrosion such as rust on the substrate, coating blistering and spallation were observed (FIG. 9).

Comparative Example 4

A tungsten carbide based powder having the formulation 86% WC-10% Co-4% Cr powder with particle size ranging from 1 to 15 microns was employed to produce a coating using a HVOF coating process. The median particle size was 8 microns. Oxygen and kerosene fuel were axially introduced separately into the inlet of the combustion chamber of a commercially available thermal spray torch (JP-5000 made by Praxair TAFA) and the tungsten carbide based powder was radially injected into the spray nozzle. The oxygen gas was introduced at 1200 scfh. The oxygen gas was not diluted. Kerosene was introduced at a flow rate of 4 gallons per hour. The tungsten carbide based powder was injected radially into the spray nozzle of the torch at a feed rate of 30 grams per min. Nitrogen carrier gas at a flow rate of 35 scfh was used to feed the tungsten carbide based powder into the spray nozzle.

The flat substrate to be coated remained stationary while the torch was traversed and indexed across the part. The standoff distance between the torch and part was 8 inches and the surface speed (i.e., torch speed) was advanced along the flat surface of the part at 1800 inches per min.

The finished unsealed coating (25 micron) was applied and tested on the flat sample having (4 in×3 in×¾ in) dimensions.

Figure 10:
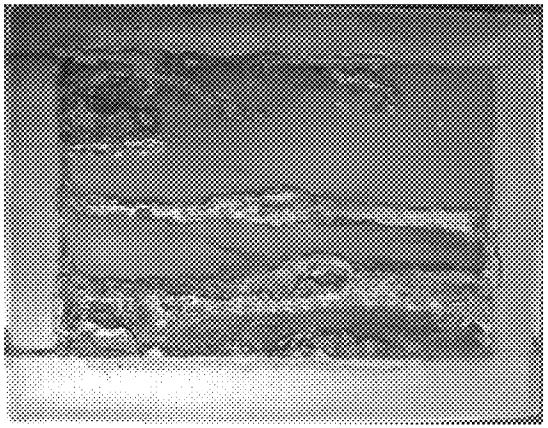
FIG. 10 shows the results of a substrate corrosion test for a tungsten carbide coating created by HVOF without oxygen dilution using a powder size of 1-15 micron.

A salt fog corrosion test was performed per ASTM B117 requirements. Within 96 hours of exposure to a salt fog, signs of corrosion such as rust on the substrate and coating blistering were observed (FIG. 10).

Example 1

A tungsten carbide based powder having the formulation 86% WC-10% Co-4% Cr with a particle size ranging from 1 to 15 microns was employed to produce a coating using a HVOF dilution process. The median particle size was 8 microns. The HVOF dilution process was performed as described hereinbefore at FIG. 1 in which the tungsten carbide based powder was injected radially into the spray nozzle of a commercially available thermal spray torch (JP-5000 made by Praxair TAFA). Oxygen gas at a flow rate of 1200 scfh was pre-mixed with nitrogen gas at a flow rate of 200 scfh to produce diluted oxygen gas. The diluted oxygen gas was subsequently injected into the combustion chamber at a total flow rate of 1400 scfh. Kerosene fuel was separately injected axially into the combustion chamber at a flow rate of 4 gallons per hour. The tungsten carbide based powder was injected radially into the spray nozzle at a flow rate of 30 grams per min. Nitrogen carrier gas at a flow rate of 35 scfh was used to feed the tungsten carbide based powder into the spray nozzle.

The substrate to be coated remained stationary while the torch was traversed and indexed across the part. The standoff distance between the torch and part was 8 inches and the surface speed (i.e., torch speed) was advanced along the flat surface of the part at 1800 inches per min.

The finished coating was applied and tested on the sample having a diameter of approximately 2.8 inches and a thickness of approximately 1.5 inches. The resultant thickness of the coating was 40 microns.

A high pressure leak test was conducted. No bubbles were observed on the tested sample as shown in FIG. 6 at an applied pressure of 10,000 psi after 15 minutes of testing. The absence of bubbles at high pressure was an indication of the ability of the thin coating to prevent leakage.

The tests demonstrate that the pre-mixing of oxygen with nitrogen gas in Example 1 in accordance with the principles of the present invention allows creation of a fluid-tight, dense coating at relatively reduced thicknesses in comparison to Comparative Example 1.

The tests demonstrate that the pre-mixing of oxygen with nitrogen gas in Example 1 in accordance with the principles of the present invention allows creation of a fluid-tight, fully dense coating at the same thicknesses as the coating of Comparative Example 2.

Example 2

A tungsten carbide based powder having the formulation 86% WC-10% Co-4% Cr with a particle size ranging from 1 to 15 microns was employed to produce a coating using a HVOF dilution process. The median particle size was 8 microns. The HVOF dilution process was performed as described hereinbefore at FIG. 1 in which the tungsten carbide based powder was injected radially into the spray nozzle of a commercially available thermal spray torch (JP-5000 made by Praxair TAFA). Oxygen gas at a flow rate of 1200 scfh was pre-mixed with nitrogen gas at a flow rate of 200 scfh to produce diluted oxygen gas. The mixture was subsequently injected into the combustion chamber at a total flow rate of 1400 scfh. Kerosene fuel was separately injected axially into the combustion chamber at a flow rate of 4 gallons per hour. The tungsten carbide based powder was injected radially into the spray nozzle at a flow rate of 30 grams per min. Nitrogen carrier gas at a flow rate of 35 scfh was used to feed the tungsten carbide based powder into the spray nozzle.

The flat substrate to be coated remained stationary while the torch was traversed and indexed across the part. The standoff distance between the torch and part was 8 inches and the surface speed (i.e., torch speed) was advanced along the flat surface of the part at 1800 inches per min.

The finished unsealed coating (25 micron) was applied and tested on the flat sample having (4 in×3 in×¾ in) dimensions.

Figure 11:
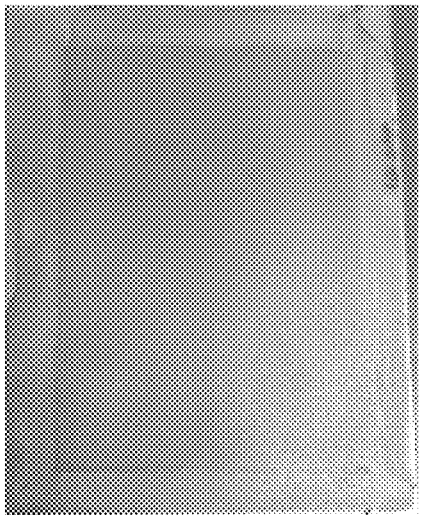
FIG. 11 shows the results of a substrate corrosion test for a tungsten carbide coating created by the present invention, as described in Example 2.

A salt fog corrosion test was performed per ASTM B117 requirements. After 1000 hours of exposure to a salt fog, no signs of corrosion were observed (FIG. 11).

The test demonstrated that the pre-mixing of oxygen with nitrogen gas in Example 2 in accordance with the principles of the present invention allows creation of a fluid-tight, dense, corrosion resistant coating at relatively reduced thicknesses in comparison to Comparative Examples 3 and 4.

In addition to the advantages already mentioned, it should be noted that the ability for the oxygen dilution HVOF process 100 to create fluid-tight and fully dense coatings that exhibits desired properties (including corrosion resistance to the substrate), at a fraction of the thickness of other coatings prepared by conventional processes, substantially reduces the cost of HVOF coatings such that the HVOF coatings prepared by the present invention emerge as a viable replacement for numerous applications, including applications which traditionally have required chrome-based coatings. In this regard, prior to the present invention, HVOF coatings prepared by conventional HVOF processes cost on average 3 times that of coating processes utilized to coat hard chrome. However, with the emergence of the present invention, the HVOF coatings lower cost significantly as a result of less coating required to generate the required properties.

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. A one-step method for creating a thin, fluid-tight, as-deposited coating without sealing the as-deposited coating, comprising:

providing a substrate;

providing a powder feedstock having a particle size ranging from 1 to 15 microns;

providing a thermal spray torch, said thermal spray torch comprising a combustion chamber with a comprising a nozzle downstream of the combustion chamber;

introducing a liquid fuel into the combustion chamber;

pre-mixing oxygen gas with an inert gas to produce diluted oxygen gas, wherein the pre-mixing occurs prior to the oxygen gas entering the combustion chamber, and wherein a flow ratio of the inert gas to the oxygen gas ranges from 8:92 to 50:50, wherein said inert gas is selected from the group consisting of nitrogen and argon, and wherein the pre-mixing of the oxygen gas with the inert gas excludes feeding air as a source of oxidant for the liquid fuel combustion;

introducing the diluted oxygen gas into the combustion chamber;

combusting the fuel with the diluted oxygen gas to generate a flame;

introducing the powder feedstock into the nozzle;

contacting the powder feedstock with the flame to produce substantially molten and semi-molten droplets; and directing the substantially molten and semi-molten droplets to the substrate to form the thin, fluid-tight, as-deposited coating.

2. The one-step method of claim 1, wherein the fuel is selected from the group consisting of a hydrocarbon and hydrogen.

3. The one-step method of claim 1, wherein the pre-mixing of the oxygen gas with the inert gas is introduced at a flow rate that is sufficient to combust the fuel.

4. The one-step method of claim 1, wherein the inert gas is pre-mixed with the oxygen at a flow rate that is sufficient to create a flame temperature in the combustion chamber that is lower in comparison to a flame temperature generated by the oxygen without premixing the inert gas.

5. The one-step method of claim 1, wherein a total flow rate of the oxygen gas and the inert gas is 500-3000 scfh.

6. The one-step method of claim 1, wherein the powder feedstock is a tungsten carbide-based material.

7. The one-step method of claim 1, wherein the powder feedstock has a particle size about 4-12 microns.

8. The one-step method of claim 1, wherein the powder feedstock has a median particle size of 6-10 microns.

9. A one-step method for creating a thin, fluid-tight, as-deposited coating without sealing the as-deposited coating, comprising:

providing a substrate;

providing a powder feedstock having a particle size ranging from 1 to 15 microns;

providing a thermal spray torch, said thermal spray torch comprising a combustion chamber and said torch further comprising a nozzle downstream of the combustion chamber enclosed therein;

introducing a liquid fuel into the combustion chamber;

pre-mixing oxygen gas with an inert gas to produce diluted oxygen gas, wherein the pre-mixing occurs prior to the oxygen gas entering the combustion chamber, and wherein a flow ratio of the inert gas to the oxygen gas ranges from 8:92 to 50:50, wherein said inert gas is selected from the group consisting of nitrogen and argon, and wherein the pre-mixing of the oxygen gas with the inert gas excludes feeding air as a source of oxidant for the liquid fuel combustion;

directing the diluted oxygen gas into the combustion chamber;

combusting the fuel with the diluted oxygen gas to generate a flame within the combustion chamber;

controlling a flame temperature in the combustion chamber;

introducing the powder feedstock into the nozzle;

heating the powder feedstock to produce substantially molten or semi-molten droplets using the powder feedstock with the particle size ranging from 1 to 15 microns;

directing the substantially molten and semi-molten droplets to the substrate to form the thin, fluid-tight, as-deposited coating.

10. The one-step method of claim 9, wherein the inert gas is nitrogen or argon, and a total flow rate of oxygen with nitrogen or argon is 500-3000 scfh.

11. The one-step method of claim 9, wherein the powder feedstock comprises a tungsten carbide-based material or a chromium carbide-based material.

12. The one-step method of claim 9, wherein the powder feedstock is injected into the nozzle in a radial direction.

13. The one-step method of claim 9, wherein the powder feedstock has a median particle size of 6-10 microns.

14. The one-step method of claim 9, wherein the pre-mixing of the oxygen gas with the inert gas results in a flow ratio of the inert gas to the oxygen gas ranging from 10:90 to 30:70.

15. The one-step method of claim 9, wherein the pre-mixing of the oxygen gas with the inert gas results in a flow ratio of the inert gas to the oxygen gas ranging from 12:88 to 18:82.

* * * * *